US009368067B2

(12) United States Patent
Kim et al.

(10) Patent No.: US 9,368,067 B2
(45) Date of Patent: Jun. 14, 2016

(54) ORGANIC LIGHT-EMITTING DIODE DISPLAY WITH DYNAMIC POWER SUPPLY CONTROL

(71) Applicant: Apple Inc., Cupertino, CA (US)

(72) Inventors: ByoungSuk Kim, Seoul (KR); Victor H. Yin, Cupertino, CA (US); Jun Qi, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 177 days.

(21) Appl. No.: 13/894,339

(22) Filed: May 14, 2013

(65) Prior Publication Data

US 2014/0340379 A1 Nov. 20, 2014

(51) Int. Cl.
*G09G 3/30* (2006.01)
*G09G 3/32* (2016.01)

(52) U.S. Cl.
CPC ..... *G09G 3/3258* (2013.01); *G09G 3/3225* (2013.01); *G09G 2320/043* (2013.01); *G09G 2320/0626* (2013.01); *G09G 2330/021* (2013.01); *G09G 2330/028* (2013.01); *G09G 2360/16* (2013.01)

(58) Field of Classification Search
CPC ..... G09G 5/02; G09G 3/30; G09G 5/00; G09G 5/10; G09G 3/32; G09G 2320/043; G06F 3/038
USPC ..... 345/76–77, 212–213, 590, 690, 82, 204
See application file for complete search history.

(56) References Cited

U.S. PATENT DOCUMENTS

| | | | | |
|---|---|---|---|---|
| 8,314,756 | B2 | 11/2012 | Rankov et al. | |
| 8,358,273 | B2 | 1/2013 | Hodge et al. | |
| 8,368,619 | B2 | 2/2013 | Tsai et al. | |
| 2006/0139263 | A1* | 6/2006 | Choi et al. | 345/76 |
| 2007/0035489 | A1* | 2/2007 | Lee | 345/77 |

(Continued)

FOREIGN PATENT DOCUMENTS

| | | |
|---|---|---|
| EP | 1916647 | 4/2008 |
| JP | 2012103713 | 5/2012 |

OTHER PUBLICATIONS

Park et al., U.S. Appl. No. 61/810,199, filed Apr. 9, 2013.

(Continued)

*Primary Examiner* — Nicholas Lee
*Assistant Examiner* — Abdul-Samad A Adediran
(74) *Attorney, Agent, or Firm* — Treyz Law Group, P.C.; G. Victor Treyz; Zachary D. Hadd

(57) ABSTRACT

A display may receive image data to be displayed for a user of an electronic device. Display driver circuitry in the display may include a timing controller that receives the image data. The timing controller can analyze frames of the image data to determine average luminance values for the frames. The display may include an array of organic light-emitting diode display pixels. Each display pixel may include a light-emitting diode. A transistor in each display pixel may be coupled in series with the light-emitting diode between positive and ground power supply terminals. The timing controller can limit peak luminance in the image data that is displayed on the array of display pixels as a function of average luminance. The timing controller can also direct power regulator circuitry to adjust a power supply voltage applied to the positive power supply terminal based on the average luminance.

20 Claims, 9 Drawing Sheets

(56) References Cited

U.S. PATENT DOCUMENTS

| | | | | |
|---|---|---|---|---|
| 2007/0139437 | A1* | 6/2007 | Boroson et al. | 345/590 |
| 2007/0182672 | A1 | 8/2007 | Hoppenbrouwers et al. | |
| 2008/0170014 | A1* | 7/2008 | Jung et al. | 345/82 |
| 2010/0149167 | A1* | 6/2010 | Hasegawa et al. | 345/213 |
| 2011/0254878 | A1 | 10/2011 | Mori et al. | |
| 2012/0038684 | A1* | 2/2012 | Ryu | 345/690 |
| 2012/0293481 | A1* | 11/2012 | Chaji | 345/212 |
| 2012/0306729 | A1 | 12/2012 | Tomida et al. | |
| 2013/0050295 | A1 | 2/2013 | Tada et al. | |
| 2013/0076803 | A1 | 3/2013 | Lee et al. | |
| 2013/0088416 | A1 | 4/2013 | Smith et al. | |
| 2013/0321364 | A1* | 12/2013 | Chong et al. | 345/204 |

OTHER PUBLICATIONS

Kim et al., U.S. Appl. No. 13/778,932, filed Feb. 27, 2013.

* cited by examiner

ORGANIC LIGHT-EMITTING DIODE DISPLAY WITH DYNAMIC POWER SUPPLY CONTROL

BACKGROUND

This relates generally to electronic devices, and more particularly, to electronic devices with displays.

Electronic devices often include displays. For example, cellular telephones and portable computers often include organic light-emitting diode displays for presenting visual information to a user.

To ensure that organic light-emitting diode displays do not consume too much power, electronic devices often use a peak luminance control algorithm (sometimes referred to as automatic current limiting). When this functionality is enabled, the peak luminance of displayed images is limited whenever the content being displayed exhibits large values of average luminance. When the average luminance of a frame of image data is low, the display is allowed to display content with a large peak luminance. In this situation, a display with sparse content such as a few icons on a black background can display the content brightly.

When the average luminance of a frame of image data is high, there is a potential for excessive current draw by the display if all of the content in the frame is displayed at maximum luminance. When the peak luminance control algorithm is used, the peak luminance of the content is reduced automatically by the display. This ensures that the amount of current and therefore the amount of power that is drawn by the display will be capped. In addition to limiting power consumption, this may help limit temperature rise in the display and thereby extend the lifetime of display pixels in the display.

Even when using peak luminance control, however, challenges remain. Further reductions in power consumption and extensions to the lifetimes of the display pixels in the display would be desirable.

SUMMARY

A display may receive image data to be displayed for a user of an electronic device. Display driver circuitry in the display may include a timing controller that receives the image data. The timing controller can analyze frames of the image data to determine average luminance values for the frames.

The display may include an array of organic light-emitting diode display pixels. Each display pixel may include a light-emitting diode. A transistor in each display pixel may be coupled in series with the light-emitting diode between positive and ground power supply terminals.

The timing controller can limit peak luminance in the image data that is displayed on the array of display pixels as a function of average luminance. As the average luminance increases, the peak luminance for the image data being displayed on the array of display pixels by the timing controller can be reduced. The timing controller can also direct power regulator circuitry to adjust a power supply voltage applied to the positive power supply terminal based on the average luminance. As the average luminance increases, the timing controller can direct the power regulator circuitry to lower the power supply voltage. As the average luminance decreases, the timing controller can direct the power regulator circuitry to increase the power supply voltage.

Further features of the invention, its nature and various advantages will be more apparent from the accompanying drawings and the following detailed description of the preferred embodiments.

DETAILED DESCRIPTION

Electronic devices may include displays. The displays may be used to display images to a user. Illustrative electronic devices that may be provided with displays are shown in FIGS. 1, 2, 3, and 4.

Figure 1:
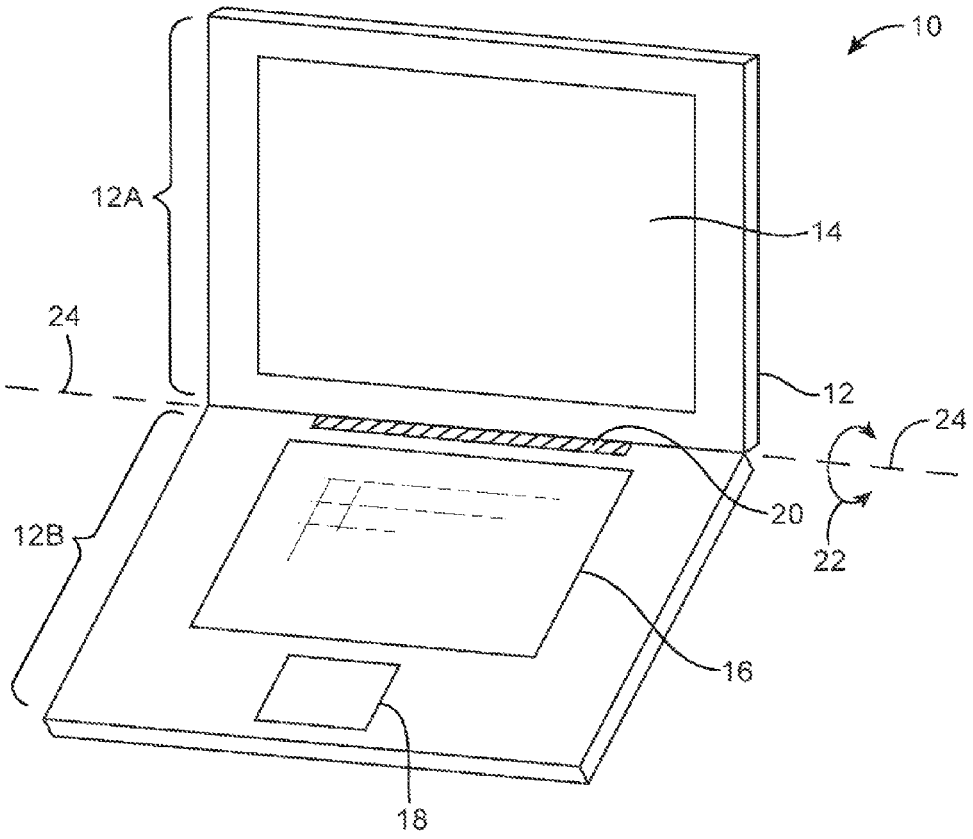
FIG. 1 is a perspective view of an illustrative electronic device such as a laptop computer with a display in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
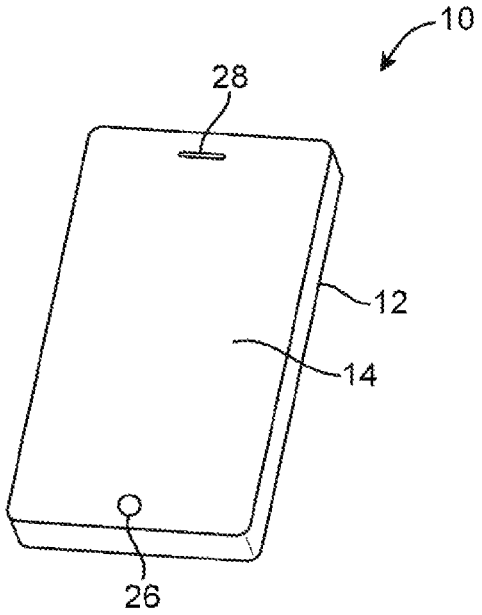
FIG. 2 is a perspective view of an illustrative electronic device such as a handheld electronic device with a display in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2).

Figure 3:
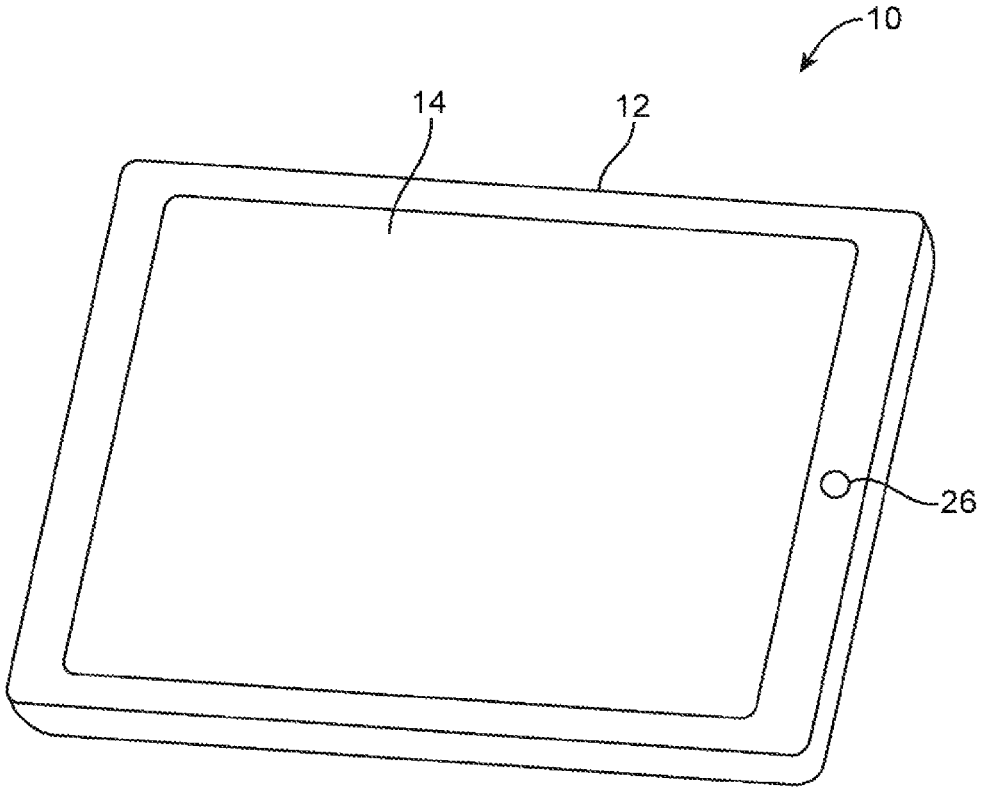
FIG. 3 is a perspective view of an illustrative electronic device such as a tablet computer with a display in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
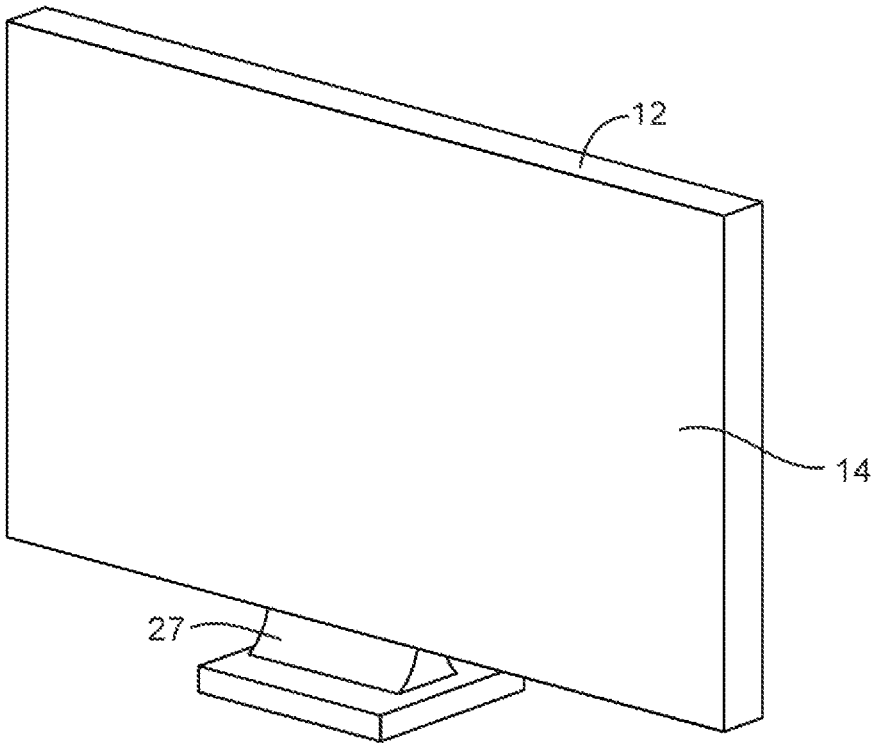
FIG. 4 is a perspective view of an illustrative electronic device such as a computer display with display structures in accordance with an embodiment of the present invention.

FIG. 4 shows how electronic device 10 may be a computer display or a computer that has been integrated into a computer display. With this type of arrangement, housing 12 for device 10 may be mounted on a support structure such as stand 27. Display 14 may be mounted on a front face of housing 12.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 includes display pixels formed from organic light-emitting diode (OLED) display components or other suitable image pixel structures.

Figure 5:
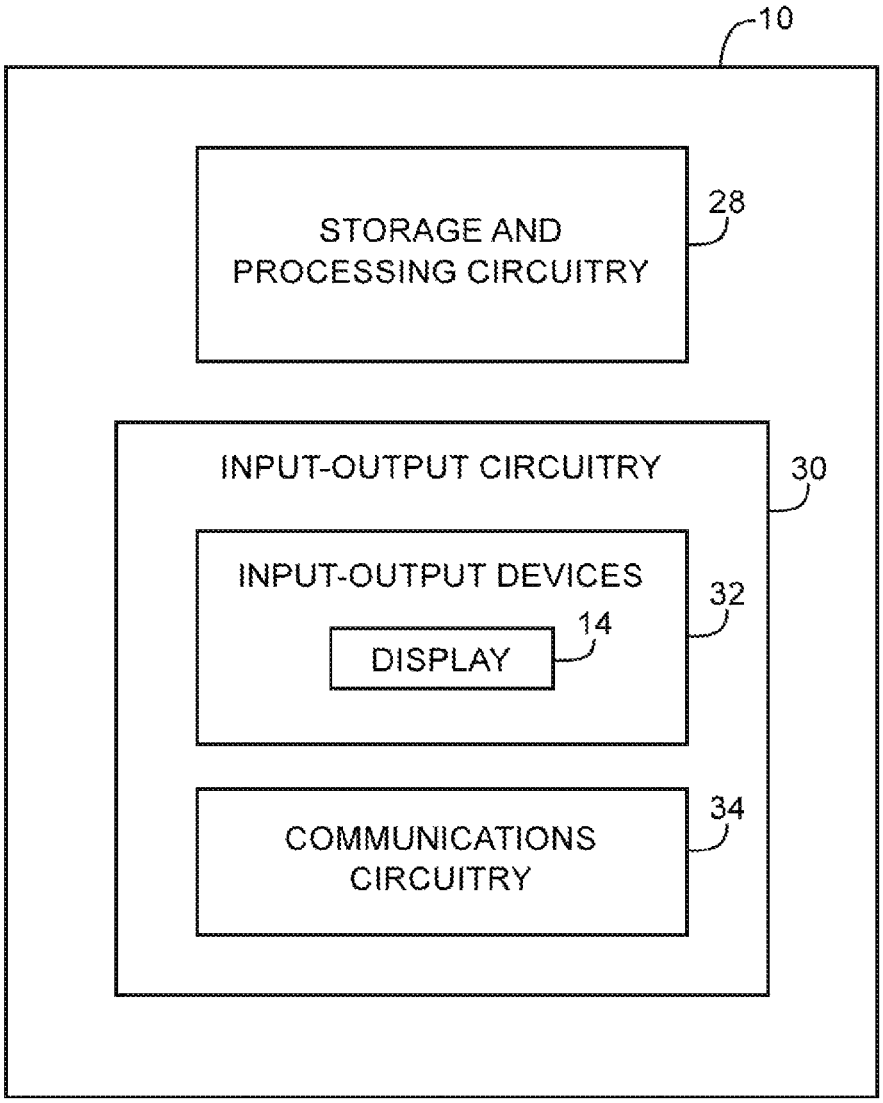
FIG. 5 is a schematic diagram of an illustrative device with a display in accordance with an embodiment of the present invention.

A schematic diagram of an illustrative configuration that may be used for electronic device 10 is shown in FIG. 5. As shown in FIG. 5, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may supply display 14 with content that is to be displayed on display 14. The content may include still image content and moving image content such as video content for a movie, moving graphics, or other moving image content. Image data for the content that is being displayed by display 14 may be conveyed between control circuitry 28 and display driver circuitry in display 14 over a data path (e.g., a flexible circuit cable with multiple parallel metal traces that serve as signal lines or other suitable communications path).

To help control power consumption and extend the lifetime of the organic light-emitting diode circuitry in display 14, control circuitry 28 and display driver circuitry in display 14 may be used in implementing a peak luminance control algorithm (sometimes referred to as an automatic current limiting algorithm) and may be used in adjusting a display power supply voltage supplied to display 14.

Input-output circuitry 30 may be used to allow data to be supplied to device 10 and to allow data to be provided from device 10 to external devices. Input-output circuitry 30 may include input-output devices 32. Input-output devices 32 may include one or more displays such as display 14 (e.g., an organic light-emitting diode display). Input-output devices 32 may also include touch screens, buttons, joysticks, click wheels, scrolling wheels, touch pads, key pads, keyboards, light-emitting diodes and other status indicators, data ports, etc. Input-output devices 32 may also include sensors and audio components. For example, input-output devices 32 may include an ambient light sensor, a proximity sensor, a gyroscope, an accelerometer, cameras, a temperature sensor, audio components such as speakers, tone generators, and vibrators or other audio output devices that produce sound, microphones, and other input-output components.

During operation, a user can control the operation of device 10 by supplying commands through input-output devices 32 and may receive status information and other output from device 10 using the output resources of input-output devices 32.

Communications circuitry 34 may include wired and wireless communications circuitry for supporting communications between device 10 and external equipment.

Figure 6:
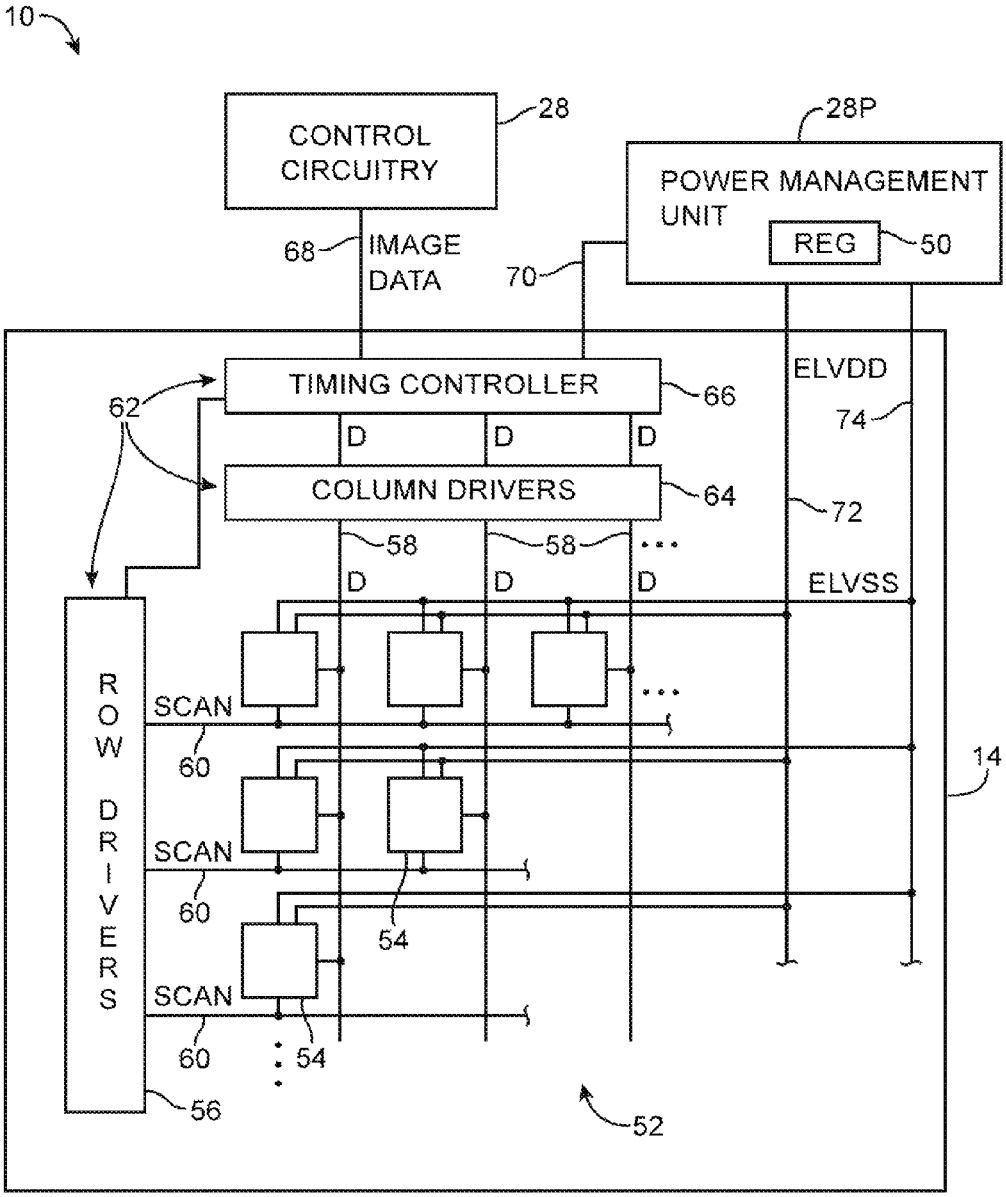
FIG. 6 is a diagram of display circuitry in accordance with an embodiment of the present invention.

A circuit diagram of display 14 is shown in FIG. 6. As shown in the illustrative configuration of FIG. 6, display 14 may have display pixels 54 organized in an array such as display pixel array 52. Display pixel array 52 may contain rows and columns of organic light-emitting diode display pixels 54 (e.g., tens, hundreds, or thousands or more rows and/or columns). Display driver circuitry 62 may include circuitry such as row driver circuitry 56, column driver circuitry 64, and timing controller circuitry 66 (sometimes referred to as a ICON integrated circuit). Row driver circuitry 56 may, if desired, be implemented using thin-film transistor circuitry on the substrate of display 14. Thin-film transistor circuitry may also be used to form array 52. Column driver circuitry 64 may, as an example, be formed from a driver integrated circuit. Other types of circuitry may be used in forming display 14, if desired.

Display driver circuitry 62 (e.g. timing controller 66) may receive still and/or moving image data (sometimes referred to as display or image data) from control circuitry 28 using communications path 68. In response, display driver circuitry 62 may provide control signals to pixels 54 on lines 58 and 60.

In particular, display driver circuitry 62 may use column drivers 64 to provide corresponding analog data signals D on data lines 58 and may use row drivers 56 to provide scan signals SCAN on scan lines 60. There may be a different respective data line 58 for each column of display pixels 54 in display pixel array 52 and a different respective scan line 60 for each row of display pixels 54.

Power can be provided to display 14 using power regulator circuitry such as power management unit 28P. Power management unit 28P may, for example, provide each of the display pixels 54 in display pixel array 52 with a positive power supply voltage ELVDD using positive power supply path 72 and a ground power supply voltage ELVSS using ground power supply path 74.

Timing controller 66 may analyze image data from control circuitry 28 that is received over path 68. This analysis may, for example, reveal information on the content of the image data such as the average luminance of each frame of the image data. Using information such as average luminance information, timing controller 66 can implement functions such peak luminance control functions to ensure that display 14 does not consume more power than desired under a variety of different luminance conditions. Timing controller 66 may also provide control signals to power management unit 28P via path 70. The control signals may direct power management unit 28P to dynamically adjust the value of output voltages such as positive power supply voltage ELVDD (and/or ground power supply voltage ELVSS). Adjustments may be made, for example, by loading control bits (sometimes called trim bits) or other control data into register circuitry such as register 50.

Figure 7:
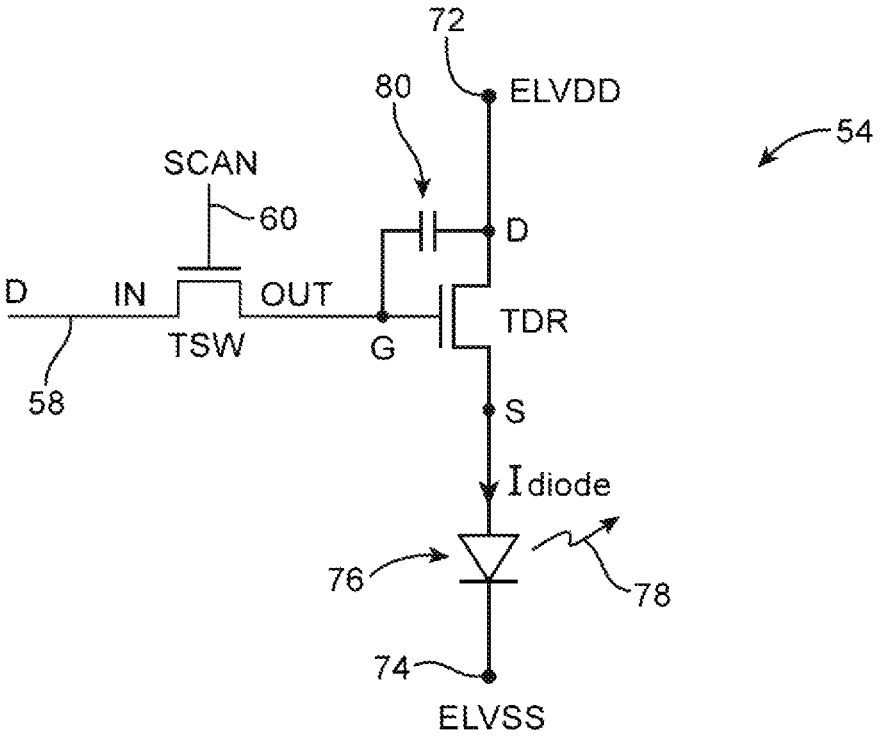
FIG. 7 is a schematic diagram of an illustrative organic light-emitting diode display pixel in accordance with an embodiment of the present invention.

A schematic circuit diagram of an illustrative display pixel in display pixel array 52 of display 14 is shown in FIG. 7. The circuitry of illustrative display pixel 54 of FIG. 7 uses thin-film transistors such as transistors TSW and TDR to apply current Idiode to organic light-emitting diode 76. The amount of light 78 that is produced by light-emitting diode 76 can be adjusted by adjusting the magnitude of current Idiode. The FIG. 7 example includes current regulating (drive) transistor TDR and switching transistor TSW. This is merely illustrative. In general, display pixel 54 may contain any suitable number of transistors (e.g., two or more, three or more, four or more, five or more, six or more, etc.).

Data signal D is applied to input IN of transistor TSW from data line 58. Input IN may serve as a data input terminal for display pixel 54. Scan line signal SCAN on scan line 60 may be asserted (taken high) when it is desired to pass data D into display pixel 54. Scan line 60 may serve as a scan input terminal for display pixel 54. Storage capacitor 80 may help store the data signal in display pixel 54 between successive frames of data.

Transistor TDR and diode 76 are connected in series between positive power supply terminal 72 and ground power supply terminal 74. The drain terminal D of transistor TDR is coupled to positive power supply terminal 72 and the source terminal S of transistor TDR is coupled to light-emitting diode 76 at the anode terminal of light-emitting diode 76. The cathode terminal of light-emitting diode 76 is coupled to ground power supply terminal ELVSS. Positive power supply voltage terminal 72 may receive positive power supply voltage ELVDD. The value of ELVDD may be dynamically adjusted by power regulator circuitry such as power management unit 28P based on control signals received from display driver circuitry 62 over path 70. Ground power supply voltage terminal 74 may receive ground power supply voltage ELVSS. When SCAN is asserted, transistor TSW will turn on and data D from terminal 58 will be passed from transistor input IN to transistor output OUT and gate G of transistor TDR. The voltage on gate G of transistor TDR controls the magnitude of diode current Idiode and therefore the amount of light 78 that is emitted by display pixel 54.

Transistor TDR is preferably operated in saturation, so that variations in power supply voltage ELVDD do not affect the magnitude of current Idiode. This helps ensure that display 14 will exhibit good display uniformity and will not be adversely affected by undesired pixel-to-pixel brightness variations.

Figure 8:
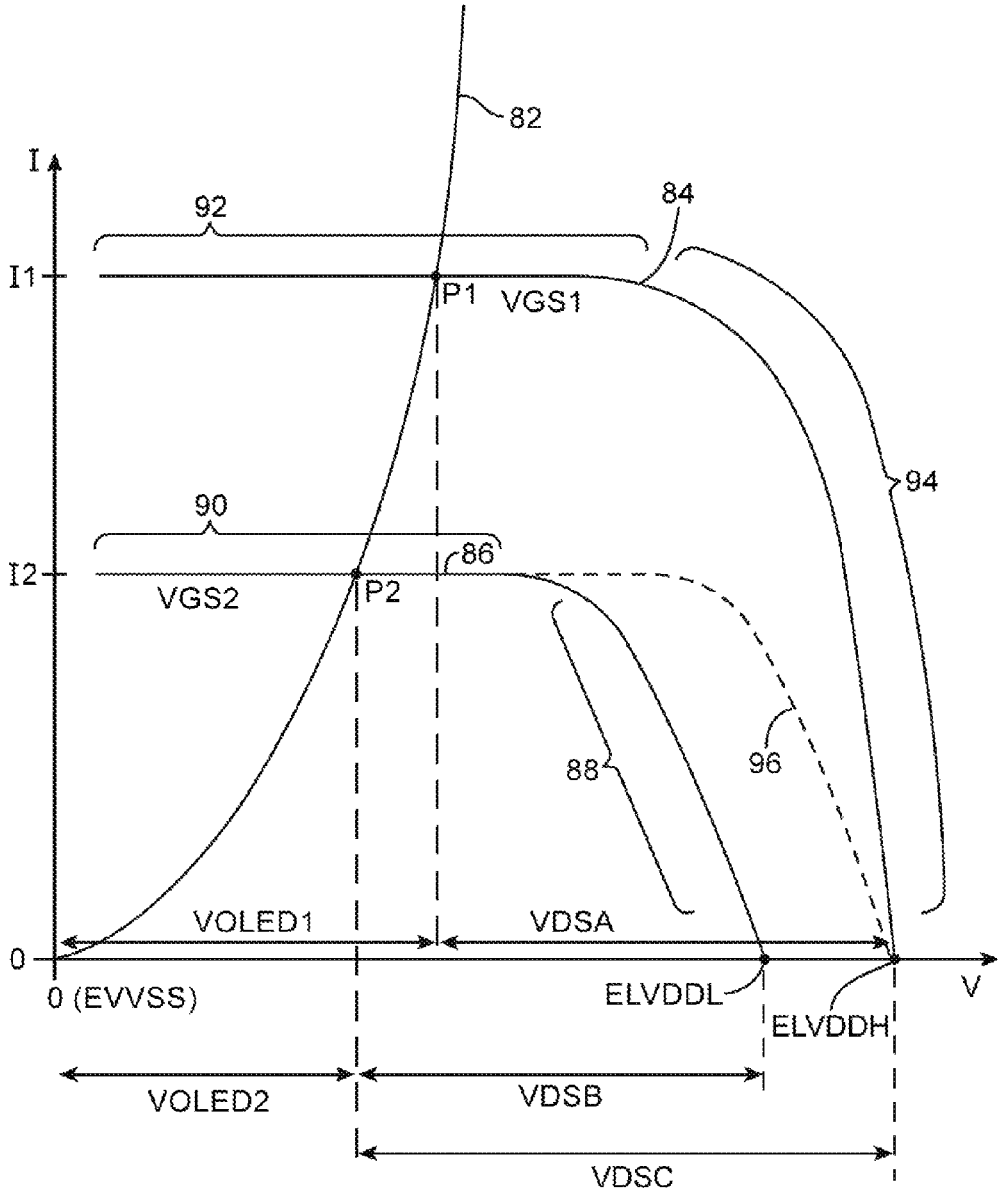
FIG. 8 is a graph showing how an organic light-emitting diode and associated current regulation circuitry may operate in a display in accordance with an embodiment of the present invention.

FIG. 8 is a graph in which the current-voltage (I-V) characteristics of transistor TDR and light-emitting diode 76 have been plotted. Curve 82 represents the current-voltage characteristic of light-emitting diode 76. Curves 84 and 86 correspond to transistor TDR when operated using two different illustrative gate voltages, VGS1 and VGS2, respectively (with VGS1>VGS2). When operated using gate voltage VGS1, transistor TDR is characterized by a saturation region 92 and linear region 94. When operated using gate voltage VGS2, transistor TDR is characterized by saturation region 90 and linear region 88. To accurately control the amount of current Idiode that is applied to light-emitting diode 76, it is desirable to operate transistor TDR in saturation and to avoid operating in linear regions such as regions 88 and 94 in which the amount of current flow would be sensitive to fluctuations in supply voltage ELVDD.

When the data signal D on line 58 is such that voltage VGS1 is applied to gate G of transistor TDR, display pixel 54 will operate at point P1, so that transistor TDR and diode 76 will carry a current I1 (i.e., Idiode will be I1). When the data signal D on line 58 is such that voltage VGS2 is applied to gate G of transistor TDR, display pixel 54 will operate at point P2, so that transistor TDR and diode 76 will carry a current 12 (i.e., Idiode will be 12).

Application of large data signals D such as signals of voltage VGS1 occurs when it is desired to display bright data (i.e., when it is desired to drive diode 76 with a relatively large current so that light 78 from light-emitting diode 76 is bright). In this situation, linear region 94 is minimized (i.e., moved to the right in the graph of FIG. 8 away from point P1) by using a relatively large value for supply voltage ELVDD (i.e., timing controller 66 may direct power management unit 28P to set ELVDD to a high value of ELVDDH). As shown on the horizontal axis of the graph of FIG. 8, when ELVDD is set to ELVDDH, there will be a voltage drop of VDSA across transistor TDR and a voltage drop of VOLED1 across diode 76. In this situation, point P1 is in saturation region 92 and there is satisfactory margin to ensure that point P1 will not enter linear region 94.

Lower magnitude data signals D such as signals of voltage VGS2 arise when it is desired to display dimmer data (i.e., when it is desired to drive diode 76 with a moderate current so that light 78 from light-emitting diode 76 is relatively dim).

When peak luminance is being controlled by timing controller 66 as part of implementing a peak luminance control algorithm, none of the display pixels 54 in array 52 will be driven with large data signals D. As a result, the highest expected magnitude of applied gate voltage G will be limited. As an example, the highest value of D might be no more than VGS2. In this type of situation it is not necessary to maintain the supply voltage ELVDD at its high value of ELVDDH. Rather, timing controller 66 can direct power management unit 28P to lower ELVDD to a reduced magnitude of ELVDDL. As shown on the horizontal axis of the graph of FIG. 8, when ELVDD is set to ELVDDL and when data signal D has a magnitude of VGS2, there will be a voltage drop of VDSB across transistor TDR and a voltage drop of VOLED2 across diode 76. In this situation, operating point P2 is in saturation region 90 and, even though ELVDDL is reduced relative to ELVDDH, there is still satisfactory margin to ensure that point P2 will not enter linear region 88.

In conventional display array powering schemes, voltage ELVDD would remain high at ELVDDH at operating point P2 and transistor TDR would have a linear region such as linear region 96. There is excessive margin in this situation, because point P2 is far from linear region 96. The high value of ELVDDH while operating at point P2 in conventional display powering schemes is therefore not necessary and results in needless power consumption and reduced diode lifetimes due to additional heating from larger ohmic losses in transistors TDR.

Figure 9:
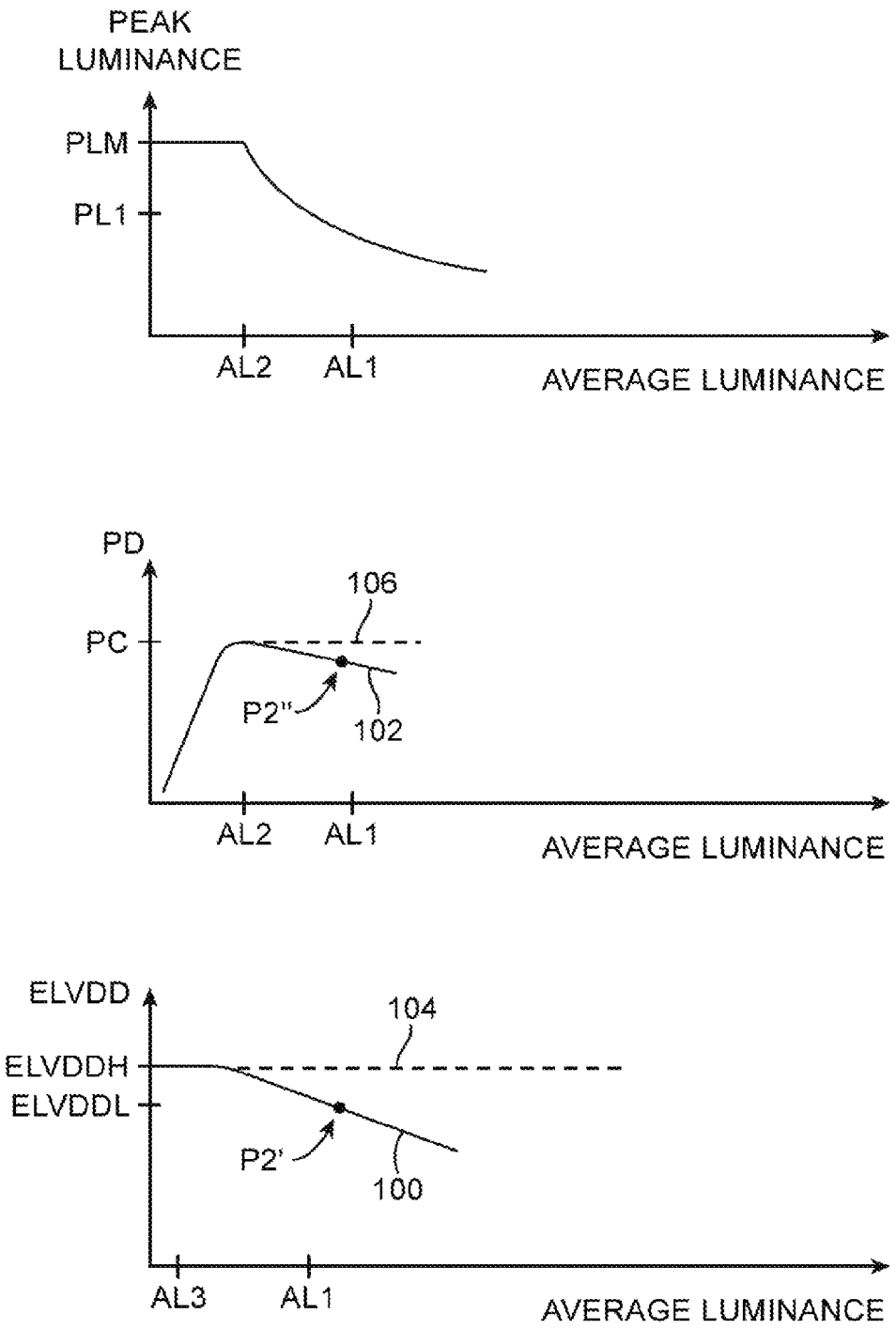
FIG. 9 contains graphs showing how peak luminance, power consumption, and display power supply voltage may be varied as a function of average luminance in frames of display data in accordance with an embodiment of the present invention.

The graphs of FIG. 9 show how a peak luminance control scheme may be used in conjunction with an ELVDD control scheme when displaying image data on display 14.

In the uppermost trace of FIG. 9, an illustrative peak luminance control function has been plotted as a function of average luminance in the image data that is being displayed. Timing controller 66 may compute the average luminance of each frame of image data being displayed. At relatively low levels of average luminance such as levels of average luminance below average luminance value AL2 in the example of FIG. 9, the peak luminance control algorithm will not impose reductions in peak luminance. Accordingly, images that are displayed by display driver circuitry 62 on display pixels array 52 may be characterized by maximum peak luminance PLM. At higher levels of average luminance, the peak luminance control algorithm restricts the peak luminance that may be displayed. For example, when the average luminance in the image data that is AL1, display driver circuitry 62 will drive data signals D into display pixel array 52 that are characterized by a reduced peak luminance of PL1.

The middle trace of FIG. 9 shows how the power PD that is consumed by display 14 can be limited by use of the peak luminance control algorithm of the uppermost trace in FIG. 9. At relatively low values of average luminance (i.e., below AL2, the power consumption of display 14 will be proportional to the average luminance value, because no reductions in peak luminance are being imposed on the displayed image data. At larger values of luminance, power consumption is limited due to the reductions in peak luminance that are imposed by the peak luminance control algorithm.

The lowermost trace of FIG. 9 shows how display power supply voltage ELVDD may be varied as a function of average luminance. Solid line 100 is an illustrative ELVDD control function that may be implemented using display driver circuitry 62 and power management unit 28P.

When display driver circuitry 62 (e.g., timing controller 66) determines that the average luminance of the image data is AL3, display driver circuitry 62 (e.g., timing controller 66) may direct power management unit 28P or other power regulator circuitry to produce an ELVDD value of ELVDDH on path 72. In this situation, the pixels of display pixel array 52 may be provided with maximum (unreduced) positive power supply voltage ELVDDH (i.e., ELVDD may be set to ELVDDH so that bright pixels may be operated at point P1 of FIG. 8).

When display driver circuitry 62 (e.g., timing controller 66) determines that the average luminance of the image data has a higher value such as AL1, display driver circuitry 62 (e.g., timing controller 66) may direct power management unit 28P or other power regulator circuitry to reduce ELVDD to a lower value such as ELVDDL. In this situation, the pixels of display pixel array 52 may be provided with lowered positive power supply voltage ELVDDL over path 72 (i.e., ELVDD may be set to ELVDDL so that pixels may be operated at points such as point P2 of FIG. 8). Because ELVDD has been lowered (as shown by point P2' of FIG. 9), power consumption PD may also be lowered, as shown by point P2" on curve 102 in the middle trace of FIG. 9. In conventional schemes, ELVDD is constant, as shown by dashed line 104 and power consumption is not reduced, as shown by dashed line 106.

Figure 10:
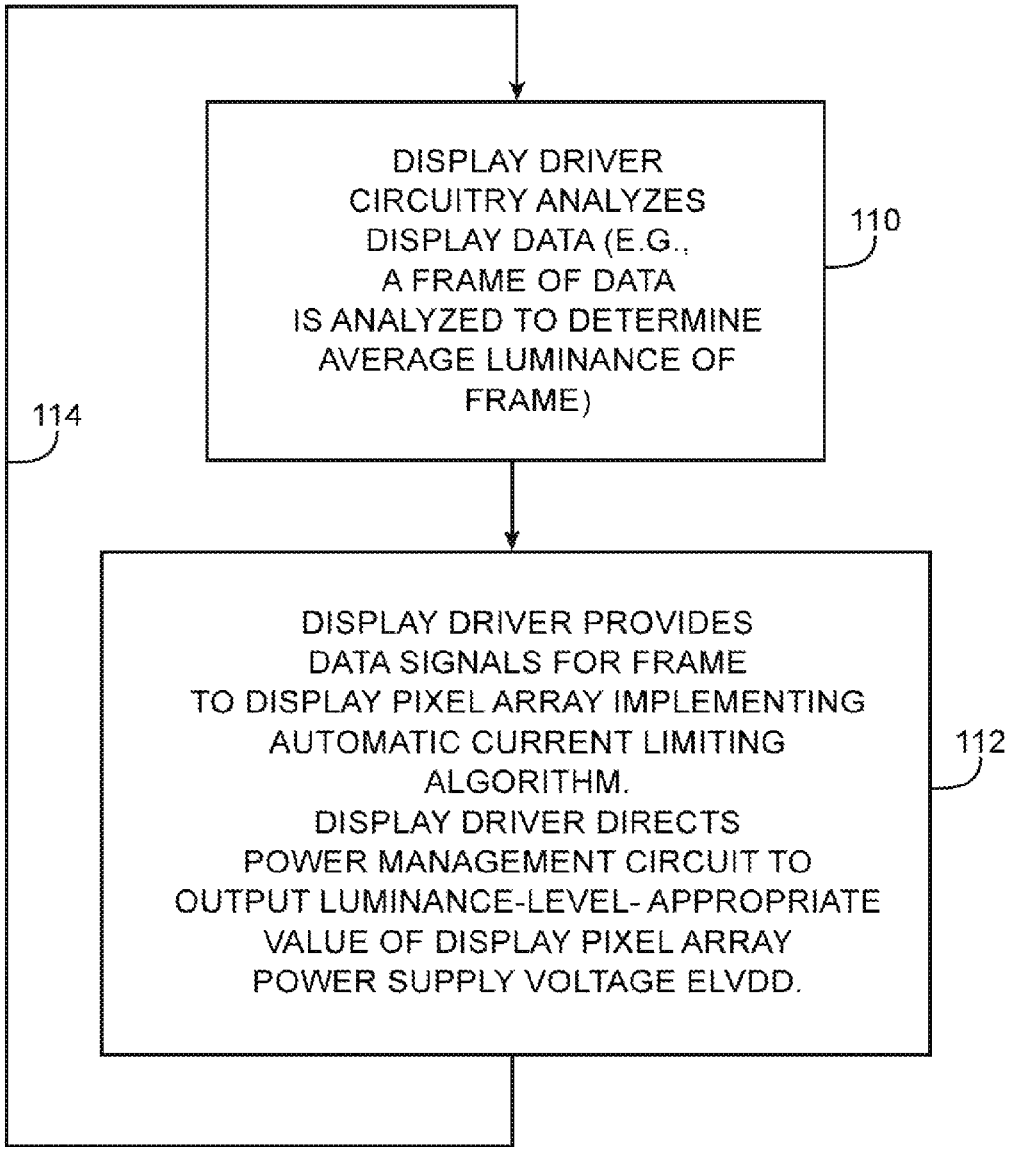
FIG. 10 is a flow chart of illustrative steps involved in controlling operation of display circuitry in accordance with an embodiment of the present invention.

FIG. 10 is a flow chart of illustrative steps involved in operating display 14. During operation of display 14, control circuitry 28 supplies image data to display 14 using a communications path such as path 66. Display driver circuitry 62 (e.g., timing controller 66) may receive the image data (e.g., image data may be received that contains image data frames) and may produce corresponding control signals on lines 58 and 60 that cause display pixels 54 in display pixel array 52 to display the image content associated with the image data (e.g., to display the image frames).

As illustrated by step 110 in FIG. 10, as control circuitry 28 provides image data to display driver circuitry 66, display driver circuitry analyzes each frame of image data to determine the average luminance of each frame.

During the operations of step 112, display driver circuitry 62 uses the average luminance values of the image data frames in displaying data on display 14 and in controlling the value of ELVDD. In particular, display driver circuitry 62 (e.g., timing controller 66) may use a peak luminance control algorithm (automatic current limiting algorithm) of the type shown in the uppermost trace of FIG. 9 to limit the peak luminance of the data being displayed by display pixels 54 in display pixel array 52 (i.e., timing controller 66 may adjust the values of data signals D to ensure that the peak luminance control values of the uppermost trace in FIG. 9 are not exceeded). At the same time, display driver circuitry 62 (e.g., timing controller 66) may direct power regulator circuitry in device 10 such as power management unit 28P to supply an appropriate average-luminance-level-based positive power supply voltage ELVDD to display 14 on positive power supply path 72. The value of ELVDD may, as an example, depend on average image data frame luminance as shown by curve 100 of FIG. 9.

As indicated by line 114, the processes of steps 110 and 112 may be continuously repeated while image data is being displayed on display 14. By increasing the positive power supply voltage ELVDD that is provided to display 14 when the average luminance of the displayed images decreases, display 14 can display data with desired brightness levels. By reducing the positive power supply voltage ELVDD that is provided to display 14 when the average luminance of the displayed image data increases, power conservation can be optimized and the operating temperature of display 14 can be reduced by eliminating some of the voltage drop across drive transistors TDR when excess ELVDD is not needed. By lowering the operating temperature of display 14 and display pixels 54 in display 14, the lifetime of light-emitting diodes such as diode 76 in the display can be increased.

The foregoing is merely illustrative of the principles of this invention and various modifications can be made by those skilled in the art without departing from the scope and spirit of the invention.

What is claimed is:

1. Display circuitry, comprising:

display driver circuitry that receives image data having average luminance values;

an array of organic light-emitting diode display pixels, each light-emitting diode display pixel having a scan input terminal that receives a scan signal from the display driver circuitry, a data input that receives a data signal from the display driver circuitry, and a power supply voltage terminal that receives a power supply voltage; and power regulator circuitry that includes a register and that dynamically adjusts the power supply voltage, wherein the power supply voltage is adjusted by adjusting bits in the register based on the average luminance values, wherein the power supply voltage has a first maximum voltage level for a first average luminance value, and wherein the power supply voltage has a second maximum voltage level that is less than the first maximum voltage level for a second average luminance value that is greater than the first average luminance value.

2. The display circuitry defined in claim 1 wherein the display driver circuitry is configured to direct the power regulator circuitry to dynamically adjust the power supply voltage.

3. The display circuitry defined in claim 2 wherein the display driver circuitry is configured to determine the average luminance values for the image data.

4. The display circuitry defined in claim 3 wherein the display driver is configured to direct the power regulator circuitry to dynamically adjust the power supply voltage.

5. The display circuitry defined in claim 4 wherein the display driver circuitry is configured to supply data signals to the data inputs in the array of light-emitting diode pixels while limiting peak luminance based on the average luminance values.

6. The display circuitry defined in claim 5 wherein the display driver circuitry is configured to direct the power regulator circuitry to reduce the power supply voltage as a function of increasing average luminance in the image data.

7. The display circuitry defined in claim 6 wherein the display driver circuitry comprises a timing controller, wherein the power regulator circuitry comprises a power management unit that includes the register, and wherein the display driver circuitry is configured to adjust the bits in the register to direct the power management unit to adjust the power supply voltage.

8. An electronic device, comprising:

control circuitry;

power regulator circuitry; and a display having an array of display pixels and having display driver circuitry that provides data signals to the display pixels, wherein the display driver circuitry is configured to receive image data from the control circuitry and to determine average luminance values for the image data, wherein the display driver circuitry is further configured to adjust the data signals based on the average luminance values and to direct the power regulator circuitry to adjust a power supply voltage that is supplied to the display based at least partly on the average luminance values, wherein each display pixel has a data input, a power supply input, and an associated organic light-emitting diode that is powered using the power supply voltage, and wherein the adjusted data signal is provided to the data input and the adjusted power supply voltage is provided to the power supply input.

9. The electronic device defined in claim 8 wherein each display pixel comprises a transistor that has a drain terminal coupled to a power supply terminal that receives the power supply voltage and that has a source terminal coupled to the organic light-emitting diode of that display pixel.

10. The electronic device defined in claim 8 further comprising a communications path between the display driver circuitry and the power regulator circuitry, wherein the display driver circuitry is configured to provide signals to the power regulator circuitry over the communications path that direct the power regulator circuitry to dynamically adjust the power supply voltage based on the average luminance values for the image data.

11. The electronic device defined in claim 8 wherein the display driver circuitry is configured to direct the power regulator circuitry to reduce the power supply voltage in response to increases in the average luminance in the image data.

12. The electronic device defined in claim 11 wherein the display driver circuitry comprises a timing controller, wherein the power regulator circuitry comprises a power management unit having a register, and wherein the display driver circuitry is configured to provide data to the register that directs the power management unit to adjust the power supply voltage.

13. A method of operating a display having an array of organic light-emitting diode display pixels each of which has a power supply terminal that receives a power supply voltage and a data input that receives a data signal, comprising:

analyzing image data with display driver circuitry to determine an average luminance value of the image data;

with the display driver circuitry, adjusting the data signal to a first level in response to a first average luminance value of the image data and adjusting the data signal to a second level that is less than the first level in response to a second average luminance value of the image data; and with the display driver circuitry, directing power regulator circuitry to adjust the power supply voltage in response to adjusting the data signal, wherein the power supply voltage has a first maximum voltage level for the first data signal level, and wherein the power supply voltage has a second maximum voltage level that is less than the first maximum voltage for the second data signal level.

14. The method defined in claim 13 wherein the image data includes frames of image data and wherein analyzing the image data comprises determining the average luminance value for each frame.

15. The method defined in claim 14 wherein directing the power regulator circuitry to adjust the power supply voltage comprises directing the power regulator circuitry to adjust the power supply voltage based on the average luminance values of the frames.

16. The method defined in claim 15 wherein the display driver circuitry includes a timing controller, the method further comprising:

providing the array of organic light-emitting diode display pixels with the data signals on data lines from the timing controller.

17. The method defined in claim 16 wherein providing the array of organic light-emitting diode display pixels with the data signals comprises using the timing controller to limit peak luminance in the organic light-emitting diode display pixels using a peak luminance control function that decreases peak luminance as a function of increases in the average luminance values.

18. The method defined in claim 17 wherein the display pixels comprise scan input terminals and wherein the display driver circuitry provides scan signals to the scan input terminals.

19. The method defined in claim 14 wherein directing the power regulator circuitry to adjust the power supply voltage comprises directing the power regulator circuitry to reduce the power supply voltage as the average luminance values of the frames increase and to increase the power supply voltage as the average luminance values of the frames decrease.

20. The display circuitry defined in claim 1 wherein the power supply voltage is adjusted by loading control bits into the register.

* * * * *